US008733434B2

(12) United States Patent
Barker

(10) Patent No.: US 8,733,434 B2
(45) Date of Patent: May 27, 2014

(54) CONNECTOR FOR USE WITH TOP DRIVE SYSTEM

(75) Inventor: Stewart John Barker, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 408 days.

(21) Appl. No.: 13/214,949

(22) Filed: Aug. 22, 2011

(65) Prior Publication Data

US 2012/0048533 A1 Mar. 1, 2012

Related U.S. Application Data

(60) Provisional application No. 61/376,601, filed on Aug. 24, 2010.

(51) Int. Cl.
*E21B 19/06* (2006.01)

(52) U.S. Cl.
USPC ..... 166/77.51; 166/77.1; 166/96.1

(58) Field of Classification Search
USPC ..... 166/77.1, 77.51, 85.1, 96.1, 75.14; 173/164; 175/162, 195; 277/401, 408
See application file for complete search history.

(56) References Cited

U.S. PATENT DOCUMENTS

| | | | | |
|---|---|---|---|---|
| 2,054,223 | A * | 9/1936 | Le Bus | 173/164 |
| 4,529,045 | A * | 7/1985 | Boyadjieff et al. | 173/164 |
| 4,809,792 | A * | 3/1989 | Lynch | 175/113 |
| 6,142,545 | A | 11/2000 | Penman et al. | |
| 6,234,260 | B1 * | 5/2001 | Coast et al. | 175/113 |
| 6,896,048 | B2 * | 5/2005 | Mason et al. | 166/78.1 |
| 7,007,753 | B2 * | 3/2006 | Robichaux et al. | 166/291 |
| 7,188,686 | B2 * | 3/2007 | Folk et al. | 175/162 |
| 7,874,352 | B2 * | 1/2011 | Odell et al. | 166/77.51 |
| 2008/0257539 | A1 | 10/2008 | Moody | |

OTHER PUBLICATIONS

"Remote Control Top-Drive Cementing Head (RC-TDH)", Weatherford International Ltd., 2006-2010, 4 pages.
"Top Drive Rig Floor Safety Orientation Doghouse Manuel", TESCO, Oct. 2006, 19 pages.
"CRT 500 Casing Running Tool", National Oilwell Varco, 1 page.
"CRT 350 Casing Running Tool", National Oilwell Varco, 1 page.

* cited by examiner

*Primary Examiner* — Kenneth L Thompson
(74) *Attorney, Agent, or Firm* — E. Randall Smith; Jones & Smith, LLP

(57) ABSTRACT

In some embodiments, apparatus connectable between a top drive system and a tool useful in connection with a hydrocarbon exploration or production well includes a rotatable barrel, a non-rotating upper housing engageable with the top drive system, a rotatable lower housing engageable with the tool and a non-rotating communication ring.

33 Claims, 5 Drawing Sheets

CONNECTOR FOR USE WITH TOP DRIVE SYSTEM

This application claims priority to U.S. Provisional Patent Application Ser. No. 61/376,601 filed Aug. 24, 2010 and Entitled "Connector for Use with Top Drive System", the disclosure of which is hereby incorporated by reference herein in its entirety.

FIELD OF THE INVENTION

The present disclosure relates generally to a connector deployed between a top drive system and a tool useful in connection with a hydrocarbon exploration or production well and methods of use thereof.

BACKGROUND

In hydrocarbon exploration and production operations, various types of tools are often engaged with "top drive" systems for conducting certain operations in the well. A few examples of tools that may, depending upon the circumstances, be driven by or associated with a top drive system are casing running tools, reaming drill bits and cementing heads. Typically, the tool is suspended below the top drive system and rotated by a shaft extending from the top drive system.

Presently available techniques for coupling the tools to the top drive systems are believed to have potential limitations. For example, many types of such tools require hydraulic or pneumatic power, electric or data transmission, or a combination thereof. This requirement often warrants the need for multiple dedicated (fluid, data, electric, etc.) communication lines to the tool. Some presently know systems may include spare communication ports or passageways which can be used for the tool, but which are difficult and time consuming to identify and connect. Other presently known systems simply do not have enough communication ports or passageways to adequately support the needs of the tool.

For another example, in some presently known systems, the communication ports or passageways are provided in a rotating component. The rotation of the component may, depending upon the circumstances, cause substantial pressure to be applied to sealing members provided therein for appropriately isolating or sealing the communication ports and passageways. This high pressure situation may lead to premature failure of the sealing members, requiring time-consuming maintenance or replacement. For yet another example, the use of a top drive system to rotate a tool may necessitate a dual load-bearing arrangement. In such instances, both the hoisting, or vertical, load of the tool (and any components or devices suspended therefrom) and the torsional load from rotation of the tool must be managed. Many presently known systems have limited load ratings and simply cannot handle large dual load capacities, limiting their usefulness.

It should be understood that the above-described examples, features and potential limitations are provided for illustrative purposes only and are not intended to limit the scope or subject matter of this disclosure or any related patent application or patent. Thus, none of the appended claims or claims of any related patent application or patent should be limited by the above examples, features and potential limitations or required to address, include or exclude the above-cited examples, features and/or potential limitations merely because of their mention above.

Accordingly, there exists a need for improved systems, apparatus and methods useful for connecting a top drive system and a tool and having one or more of the attributes, capabilities or features described below or evident from the appended drawings.

BRIEF SUMMARY OF THE DISCLOSURE

In some embodiments, the present disclosure involves apparatus for allowing communication of one or more medium between at least one external source and a tool associated with a top drive system. The top drive system includes a rotatable shaft extendable to the tool. The apparatus includes a rotatable barrel positionable between the top drive system and the tool. The barrel has an upper end, a lower end and a central bore through which the rotatable shaft of the top drive system may extend and freely rotate. The barrel includes a plurality of passages formed therein and being isolated from one another. Each passage extends to a distinct exit port formed in the barrel. At least one medium may be communicated between each exit port and the tool.

In these embodiments, a non-rotating upper housing extends at least partially around the barrel and includes at least one coupler engageable with the top drive system. A lower housing extends at least partially around the rotatable barrel between the upper housing and the lower end of the barrel. The lower housing has at least one coupler engageable with the tool and is rotatable. A non-rotating communication ring extends at least partially around the barrel and has a plurality of separate passageways formed therein and extending therethrough. Each passageway is in communication with a distinct groove formed in and extending around the inner surface of the communication ring. Each groove is in communication with one of the passages of the barrel regardless of the rotational movement of the barrel. Each corresponding passageway and groove is isolated from the other passageway/groove combinations and is capable of communication with at least one external source. Thus, at least two distinct, isolated flow paths are formed by the passageway and groove combinations of the communication ring and the corresponding respective passages and exit ports of the barrel, allowing communication of at least one medium between at least one external source and the tool.

In various embodiments, the present disclosure involves apparatus for allowing communication of one or more medium between at least one external source and a tool associated with a top drive system. The top drive system includes a rotatable shaft extendable downwardly to the tool. The apparatus includes a rotatable barrel positionable between the top drive system and the tool. The barrel has an upper end, a lower end and a central bore through which the rotatable shaft of the top drive system may extend and freely rotate. The barrel includes a plurality of grooves formed in the outer surface thereof and extending around the circumference thereof. Each groove is isolated from the other grooves. The barrel also includes a plurality of passages formed therein and isolated from one another. Each passage extends from a different groove to a distinct exit port formed in the barrel. At least one medium may be communicated between each exit port and the tool.

The apparatus of these embodiments also includes a non-rotating upper housing extending at least partially around the barrel and having at least one coupler engageable with the top drive system. A lower housing extends at least partially around the barrel between the non-rotating upper housing and the lower end of the barrel. The lower housing has at least one coupler engageable with the tool and is rotatable. A non-rotating communication ring extends at least partially around the barrel and has a plurality of separate passageways formed therein and which extend therethrough. Each passageway is in communication with one of the grooves of the barrel regardless of the rotational movement of the barrel. Each passageway is isolated from the other passageways and capable of communication with at least one external source. Accordingly, at least two distinct, isolated flow paths are formed by the passageways of the communication ring and the corresponding respective grooves, passages and exit ports of the barrel, allowing communication of at least one medium between at least one external source and the tool.

In many embodiments, the present invention involves apparatus for allowing fluid flow between at least one external source and a tool driven by a top drive system. The tool is useful in connection with a hydrocarbon exploration or production well. The top drive system includes a rotatable shaft extendable to the tool. The apparatus includes a rotatable barrel positionable between the top drive system and the tool. The barrel has an upper end, a lower end and a central bore through which the rotatable shaft of the top drive may extend and freely rotate. The barrel includes a plurality of distinct passages formed therein and which are fluidly isolated from one another. Each passage extends to a distinct exit port formed in the barrel. Fluid may be communicated between each exit port and the tool.

The apparatus of these embodiments also includes a non-rotating upper housing extending at least partially around the barrel and having at least one coupler engageable with the top drive system. A lower housing extends at least partially around the barrel between the non-rotating upper housing and the lower end of the barrel. The lower housing has at least one coupler engageable with the tool and is rotatable. A communication ring extends at least partially around the barrel and has a plurality of separate passageways formed therein and extending therethrough. Each passageway is in constant fluid communication with one of the passages of the barrel regardless of the rotational movement of the barrel. Each passageway is fluidly isolated from the other passageways and capable of fluid communication with at least one external fluid source. Thus, at least two distinct, fluidly isolated flow paths are formed by the passageways of the communication ring and the corresponding respective passages and exit ports of the barrel, allowing fluid communication between at least one external source and the tool.

Accordingly, the present disclosure includes features and advantages which are believed to enable it to advance operations involving top drive systems and tools associated therewith. Characteristics and potential advantages of the present disclosure described above and additional potential features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PRESENTLY PREFERRED EMBODIMENTS

Figure 1:
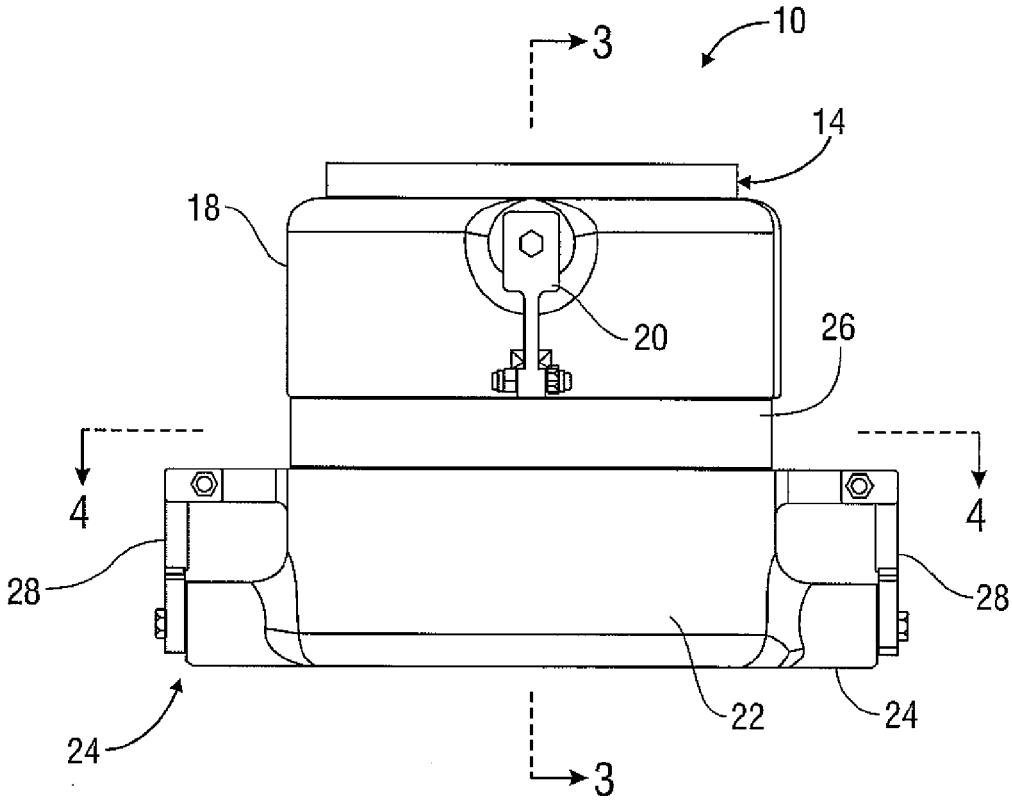
FIG. 1 is a side view of an embodiment of a connecting system in accordance the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application, any patent granted hereon or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments, common or similar elements are referenced in the appended figures with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged", "carried" and the like, and variations thereof, as used herein and in the appended claims are intended to mean either an indirect or direct connection or relationship. For example, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . " Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Figure 8:
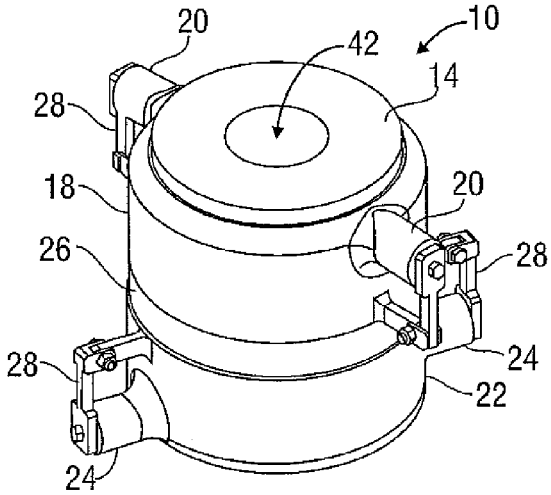
FIG. 8 is a perspective view of the exemplary connecting system of FIG. 1.

Referring initially to FIG. 1, a connecting system 10 in accordance with an embodiment of the present disclosure is shown including a barrel 14, upper housing 18, lower housing 22 and communication ring 26 (see also FIG. 8). As illustrated in the block diagram of FIG. 2, the connecting system 10 is typically engaged between a top drive system 30 and one or more tool 34 driven by, or associated with, the top drive system 30. As is know, a typical top drive system 30 includes a rotatable shaft 32 which may be coupled to the tool 34 and used to drive and/or rotate the tool 34 (and/or other devices or components associated with the tool 34). Otherwise, the top drive system 30 may include any arrangement of components as is and becomes known in the art. One example of presently commercially available top drive systems are the Varco TDS-11SA top drive system. It should be understood that the present disclosure and appended claims are not limited by the type, configuration, operation or other details of the top drive system 30, except and only to the extent as may be expressly recited in a particular instance.

The tool 34 may be any device or arrangement of components that may be associated with or driven by a top drive system 30 and which is useful in connection with a hydrocarbon exploration and/or production well (not shown) typically accessible below the top drive system 30. In the present embodiment, the tool 34 is rotatable along with the rotation of the rotatable shaft 32 of the top drive system 30. However, there may be instances when the tool 34 is not rotatable. Some examples of tools 34 are casing running tools, cementing heads and reaming drill bits. A few examples of presently commercially available casing running tools are the dual load path CRT 500 and CRT 350 by National Oilwell Varco. However, the tool 34 is not limited to any of these examples. Moreover, the present disclosure and appended claims are not limited by the type, configuration, operation or other details of the tool 34, except and only to the extent as may be expressly recited therein in any particular instance. In some circumstances, the tool 34 may carry, or be engaged or otherwise associated with, additional devices or components useful in connection with the well.

Figure 2:
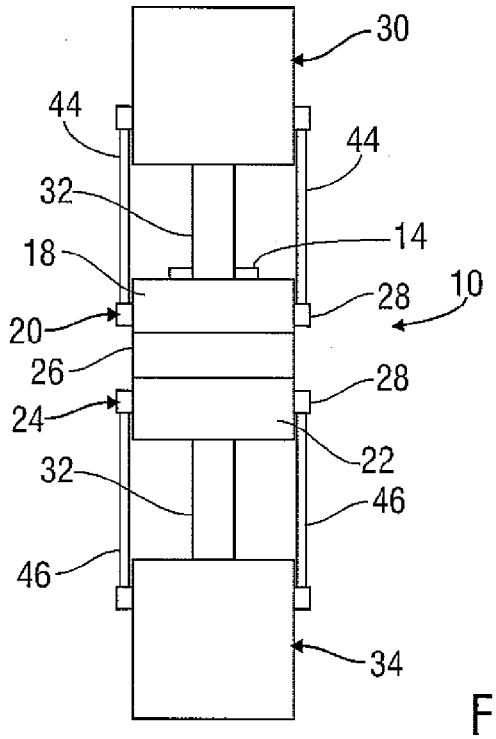
FIG. 2 is a block diagram illustrating an embodiment of a connecting system in accordance with the present disclosure engaged between a top drive system and tool.
Figure 3:
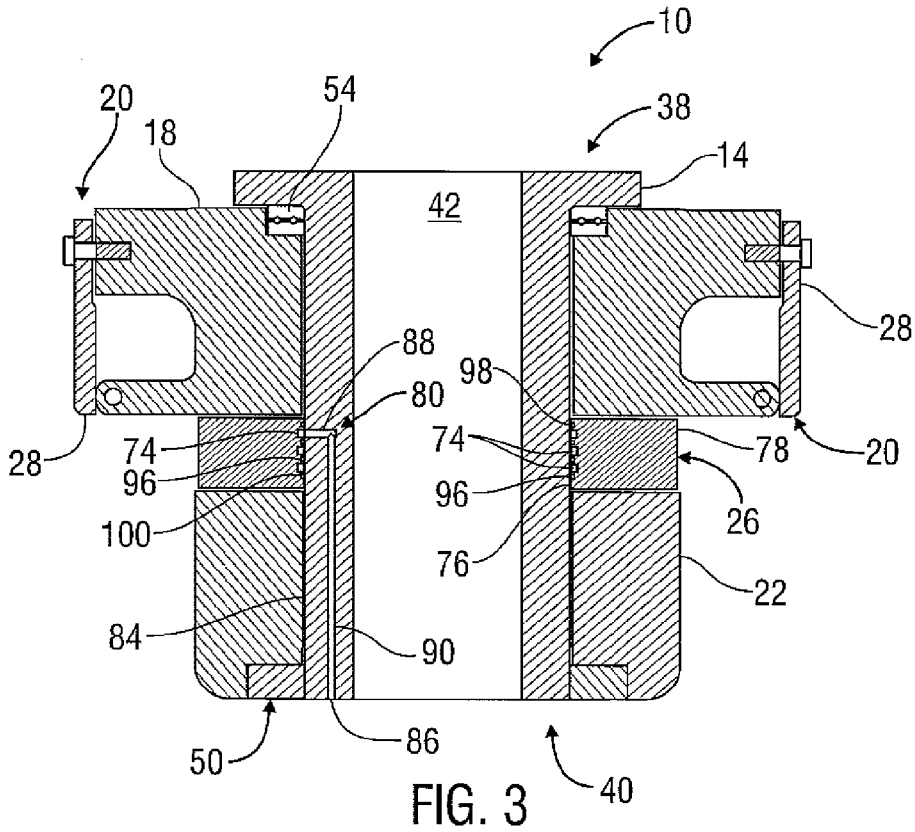
FIG. 3 is a cross-sectional view of the exemplary connecting system of FIG. 1 taken along lines 3-3.

Referring now to FIG. 3, the barrel 14 of this embodiment has an upper end 38, a lower end 40 and a central bore 42 through which the rotatable shaft 32 (FIG. 2) of the top drive system 30 extends and freely rotates. In this example, after extending through the bore 42, the rotatable shaft 32 may thus engage and rotate the tool 34 so that the top drive system 30 directly bears the torsional load. The exemplary housings 18, 22 and communication ring 26 are each annular-shaped and extend around the outside of the barrel 14. In this embodiment, the lower housing 22 is positioned below the upper housing 18, while the communication ring 26 is disposed between the housings 18, 22. However, in other embodiments, any among the housings 18, 22 and communication ring 26 may not be annular-shaped and may extend only partially around the barrel 14. Further, there may be embodiments where these components are positioned in other locations. For example, the communication ring 26 may be positioned above the upper housing 18 or below the lower housing 22. In some embodiments, one of more of these components may be integrally formed with one another. For example, the communication ring 26 maybe integrally formed with the upper housing 18.

Figure 5:
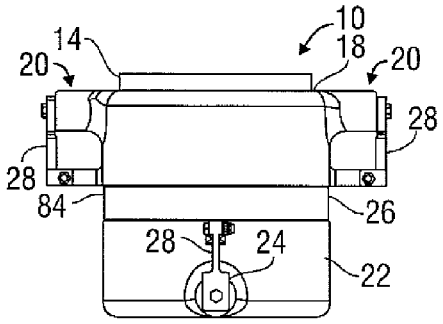
FIG. 5 is a side view of the exemplary connecting system of FIG. 1.

The illustrated upper housing 18 includes at least one coupler 20 (FIGS. 3 & 5) engageable with a non-rotating component (not shown) of the top drive system 30 (FIG. 2). In this arrangement, the upper housing 18 is non-rotating. The exemplary lower housing 22 includes at least one coupler 24 (FIG. 1) engageable with the tool 34 (FIG. 2). Since the tool 34 may rotate, the exemplary lower housing 22 is configured to rotate along with the tool 34.

Figure 6:
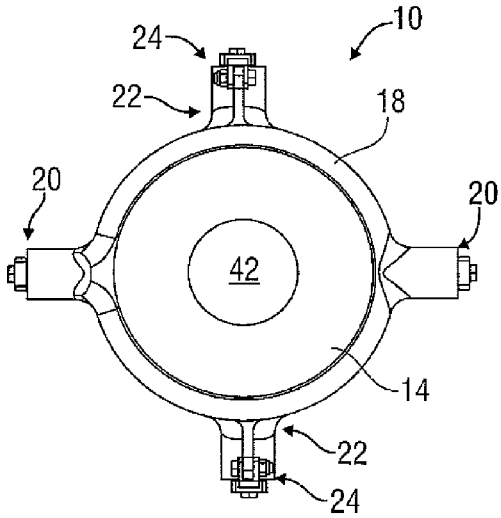
FIG. 6 is a top view of the exemplary connecting system of FIG. 1.

In the present embodiment, the upper and lower housings 18, 22 each include two couplers 20, 24 (FIG. 6). However, any suitable number and arrangement of couplers 20, 24 may be included. For example, some embodiments may involve only one coupler 20, 24 or more than two couplers 20, 24, respectively. The couplers 24 may have any suitable form, configuration and operation. In the illustrated embodiment, each coupler 20, 24 includes a releasable link retainer 28. The exemplary link retainers 28 on the upper housing 18 are each releasably engageable with a different bail arm 44 (FIG. 2) extending downwardly from the top drive system 30. The exemplary link retainers 28 on the lower housing 22 are each releasably engageable with a different link 46 (FIG. 2) extending upwardly from the tool 34.

Referring again to FIG. 3, the illustrated barrel 14 is coupled to the lower housing 22. Thus, in this embodiment, the barrel 14 and lower housing 22 are rotatable together and relative to the non-rotating upper housing 18 and communication ring 26. The barrel 14 and lower housing 22 may be coupled together in any suitable manner. For example, at least one retainer 50 may be engaged between the lower housing 22 and barrel 14 and used to couple them together. The retainer 50 may have any suitable form, configuration and operation. For example, in some embodiments, the retainer 50 may be a releasable retainer ring (not shown) threadably engaged with the barrel 14 or bolted between the barrel 14 and lower housing 22 proximate to the lower end 40 of the barrel 14. For another example, the retainer 50 may include at least one keyless ring fetter shaft coupling (not shown) disposed between the barrel 14 and lower housing 22. For yet another example, the retainer 50 may be more permanently engaged between the barrel 14 and lower housing 22, such as by welding. In various embodiments, the barrel 14 and lower housing 22 may instead be directly connected or integrally formed.

If desired, the connecting system 10 may be configured to transfer the vertical load of the tool 34 (FIG. 2) and any other devices or components carried thereby to the top drive system 30. The vertical load may be transferred to the top drive system 30 in any suitable manner. In the present embodiment, the lower housing 22 bears the vertical load of the tool 34 and transfers that load through the upper housing 18 to the top drive system 30. For example, in the embodiment of FIG. 3, one or more bearing assemblies 54 may be included to assist in the vertical load transfer from the lower housing 22 to the top drive system 30. If included, the bearing assembly 54 may have any suitable form, configuration and operation. A few example types of bearing assemblies 54 that may be useful in some embodiments of the connecting system 10 are annular sealed spherical roller thrust bearings and tapered roller thrust bearings. One presently commercially available bearing assembly that may be useful in some embodiments of the connecting system 10 is the SKF sealed spherical roller bearings. However, the present disclosure and appended claims are not limited by the type, configuration, operation and other details of the roller bearing assembly 54, except and only to the extent as may be expressly recited in a particular instance.

In the illustrated embodiment, as shown in FIG. 3, a single annular bearing assembly 54 is disposed between the barrel 14 and the upper housing 18. In this instance, the vertical load borne by the lower housing 22 is transferred to the barrel 14 via the retainer 50, and through the bearing assembly 54 to the upper housing 18, then to the top drive system 50. However, the bearing assembly 54 may be positioned in any other suitable location in the connecting system 10, such as below the lower housing 22 or between the upper and lower housings 18, 22. Further, multiple bearing assemblies 54 may be included. The illustrated bearing assembly 54 also serves the additional role of assisting in allowing rotation of the barrel 14 and lower housing 22 relative to the upper housing 18 and communication ring 26. For example, the bearing assembly 54 may be selected and the connecting system 10 designed to allow the bearing assembly 54, barrel 14 and lower housing 22 to rotate up 50 rpm and support a vertical load of up to approximately 500 tons. Other example arrangements may allow higher or lower rotational speeds and vertical load capacities.

Figure 4:
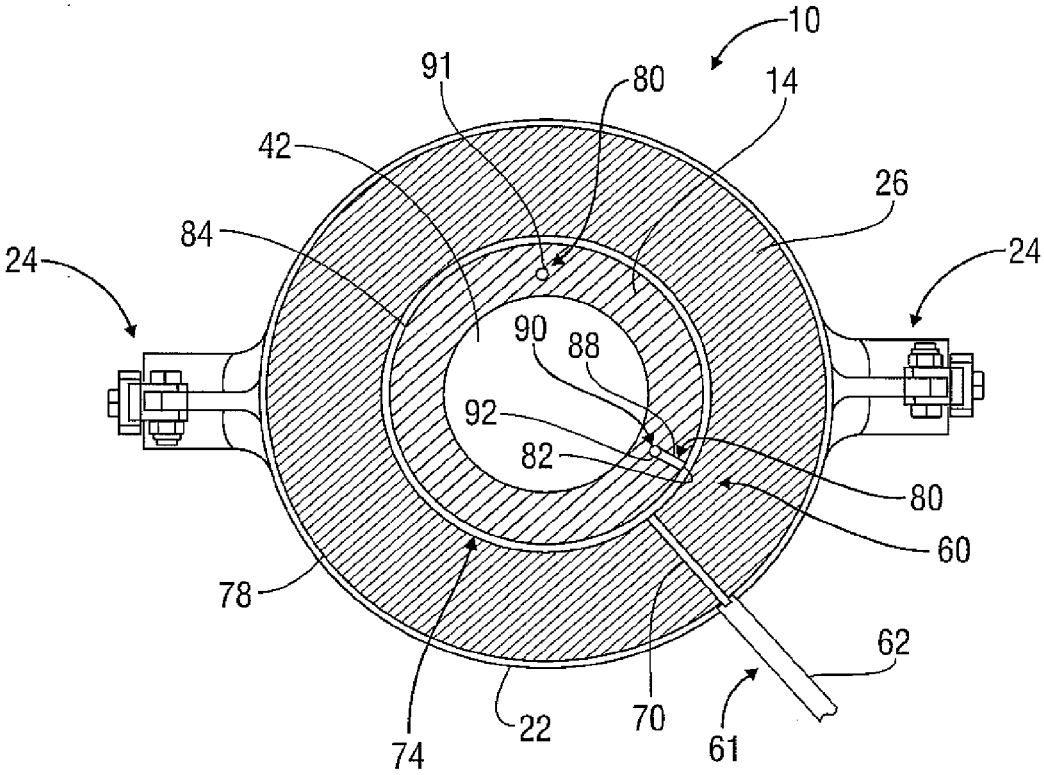
FIG. 4 is a cross-sectional view of the exemplary connecting system of FIG. 1 taken along lines 4-4.

Now referring to FIG. 4, in another independent aspect of the present embodiment, at least one distinct flow path 60 is provided through the communication ring 26 and barrel 14 to allow the communication of some desired medium or media between one or more external source 61 and the tool 34 (and/or components or devices associated with the tool 34). The present embodiment includes three flow paths 60 (e.g. FIG. 9). However, any desired number of flow paths 60 may be included. For example, some embodiments of the connecting system 10 may include five, seven or ten flow paths 60. As used herein, the term "medium" and variations thereof means liquid, gas, electricity, electronic or other signals, data or anything else that can be communicated to or from the tool 34 (or a component or device associated therewith), or a combination thereof. The external source 61 is capable of carrying or delivering the medium or media. For example, when the medium is liquid and/or gas, the external source 61 may be a pneumatic or hydraulic input or exhaust tubing or line 62. However, the present disclosure and appended claims are not limited by the type, nature, configuration, operation or other details of the external sources or media, except and only to the extent as may be expressly recited in a particular instance.

Still referring to FIG. 4, the flow path(s) 60 may have any suitable form, configuration and orientation. In the present embodiment, each flow path 60 is formed by a passageway 70 extending through the communication ring 26, a groove 74 extending around the inner surface 76 of the communication ring 26 and a passage 80 (FIG. 3) extending through the barrel 14. In this example, the multiple flow paths 60 are entirely isolated from one another to provide multiple distinct paths for communication of one or more medium to the tool. Thus, if desired, each flow path 60 may be dedicated to a separate external source 61. For example, a first flow path 60 may be used for the input of hydraulic fluid to the tool 34, a second flow path 60 for hydraulic fluid output from the tool 34, a third path 60 for pneumatic pressure input to the tool 34, a fourth flow path 60 for pneumatic pressure output from the tool 34 and so on. In some cases, the tool 34 may require five, six, seven or more isolated, dedicated hydraulic and/or pneumatic lines. However, in some embodiments, two or more flow paths 60 may communicate with or intersect one another, if desired.

In the present embodiment, as shown in FIG. 4, each distinct passageway 70 of the communication ring 26 is shown extending from the outer surface 78 thereof to a respective, corresponding, aligned groove 74 formed in and extending around the inner surface 76 thereof. The external source 61, such as the line 62, is engageable with a passageway 70 at the outer surface 78, such as through an adapter (not shown). In this example, the medium or media thus passes through a passageway 70 to its associated dedicated groove 74. Since the communication ring 26 of this embodiment is non-rotating, the connection therewith to the external source(s) 61 may be more reliably maintained as compared to an arrangement in which the communication ring 26 rotates.

Figure 9:
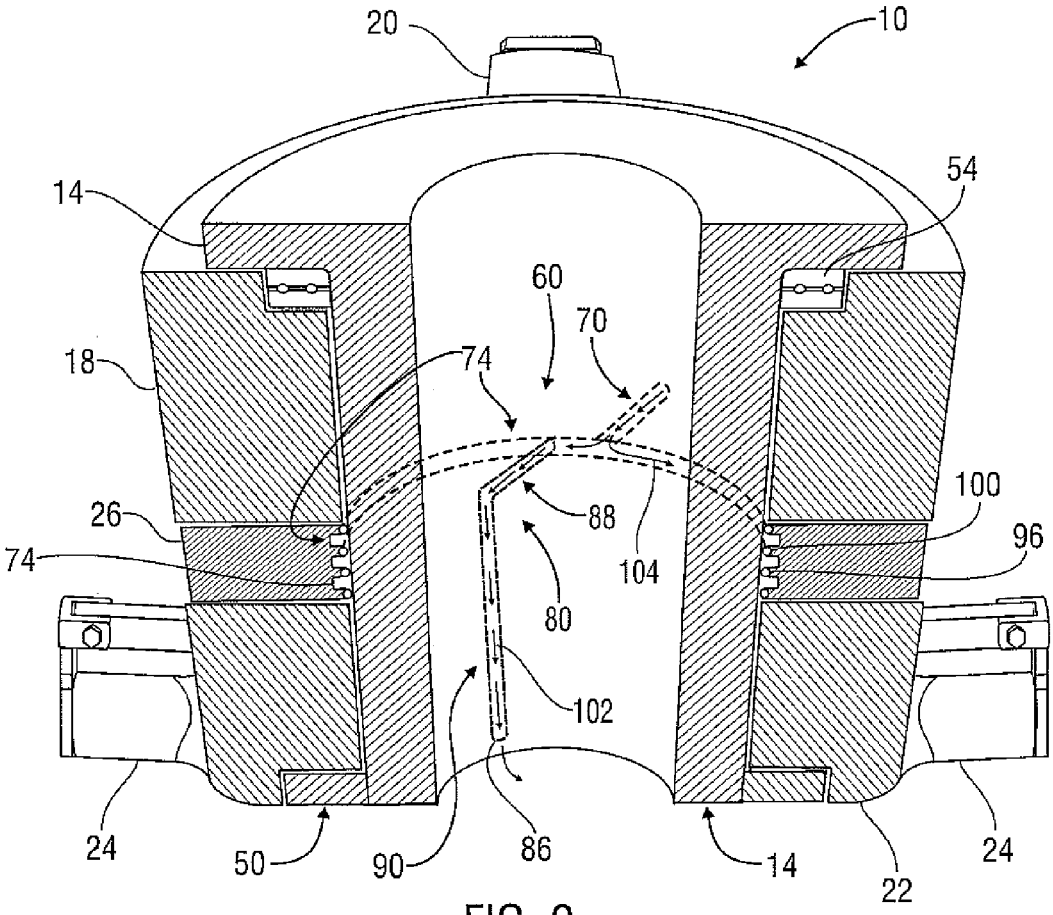
FIG. 9 is a cross-sectional view of the exemplary connecting system of FIG. 8 showing an example fluid flow path.

In this embodiment, multiple distinct passageway 70/groove 74 combinations are formed in the ring 26 at different height to allow their isolation relative to one another. For example, FIG. 3 illustrates three grooves 74 of a communication ring 26 having a three passageway 70/groove 74 arrangement. When the medium flowing through each exemplary flow path 60 is fluid, the respective passageway/groove combinations are fluidly isolated from one another. The groove(s) 74 may have any suitable shape and orientation sufficient to contain the medium or media. In the example shown, the grooves 74 have a generally U-shaped cross-sectional shape. Each illustrated groove 74 spans the interior circumference of the communication ring 26 so that the desired medium, such as fluid, may flow or pass freely therearound. For example, arrow 104 in FIG. 9 shows fluid flowing partially around an illustrated groove 74. However, in other embodiments, the grooves 74 may have different shapes and may not span the entire interior circumference of the ring 26.

Figure 7:
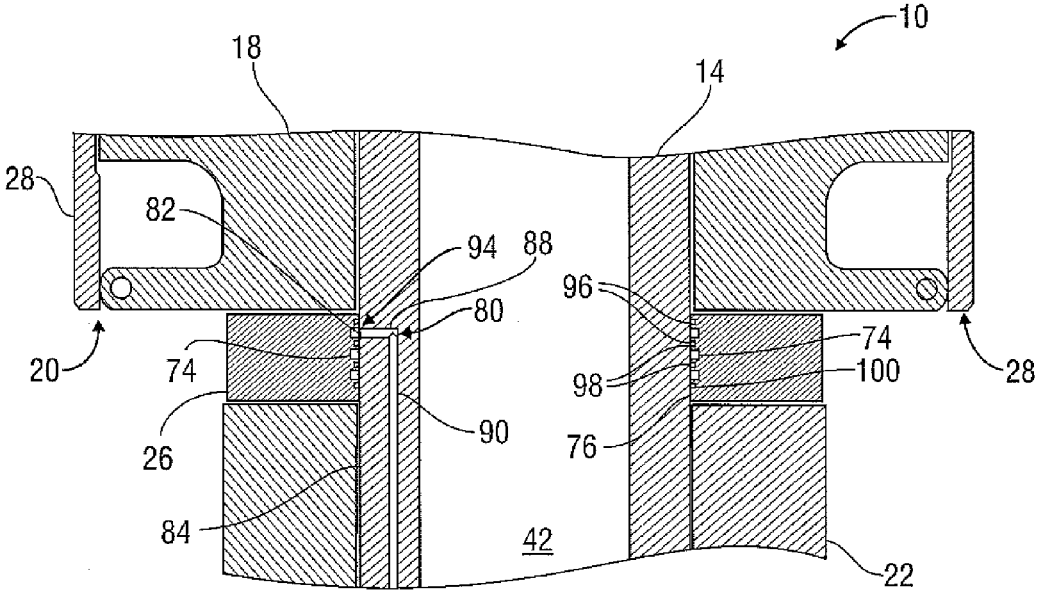
FIG. 7 is an exploded partial view of FIG. 3.

Referring now to FIG. 7, each illustrated groove 74 aligns and communicates with a distinct passage 80 formed in the barrel 14 (see also FIG. 3). The passages 80 may have any suitable configuration and arrangement that allows communication of the medium or media from the corresponding passageway 70/groove 74 combinations to a location accessible by the tool 34. In the present embodiment, the exemplary passages 80 each extend from a distinct entry port 82 (FIG. 4) formed in the outer surface 84 of the barrel 14 to a distinct exit port 86 (FIG. 3) disposed at or near the lower end 40 of the barrel 14. Each illustrated entry port 82 is located at a different height on the outer surface 84 of the barrel 14 in alignment with a respective corresponding groove 74 of the ring 26, forming a respective distinct flow interface 94 between the communication ring 26 and barrel 14. In this example, each passage 80 has a transverse portion 88 and a longitudinal portion 90, which do not intersect with the other passages 80 to maintain isolation of the flow paths 60 relative to one another. For example, FIG. 4 illustrates the longitudinal portion 91 of the "uppermost" passage 80 isolated from the longitudinal portion 92 of the "middle" passage 80.

As shown in FIG. 4, each groove 74 of the communication ring 26 of this embodiment remains in constant communication with the corresponding passage 80 of the barrel 14, allowing for uninterrupted flow or transmission of the desired medium or media therethrough, regardless of the rotational motion or position of the barrel 14 relative to the non-rotating communication ring 26. An example of fluid flow through the flow path 60 (passageway 70, groove 74 and passage 80) is illustrated with arrow 102 in FIG. 9.

Figure 10:
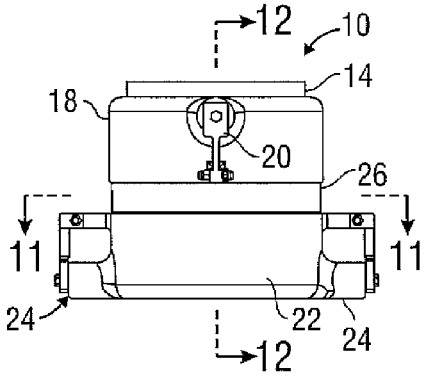
FIG. 10 is a side view of another embodiment of a connecting system in accordance with the present disclosure.
Figure 11:
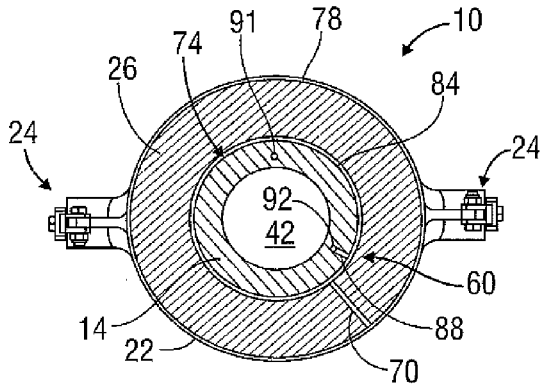
FIG. 11 is a cross-sectional view of the exemplary connecting system of FIG. 10 taken along lines 11-11.
Figure 12:
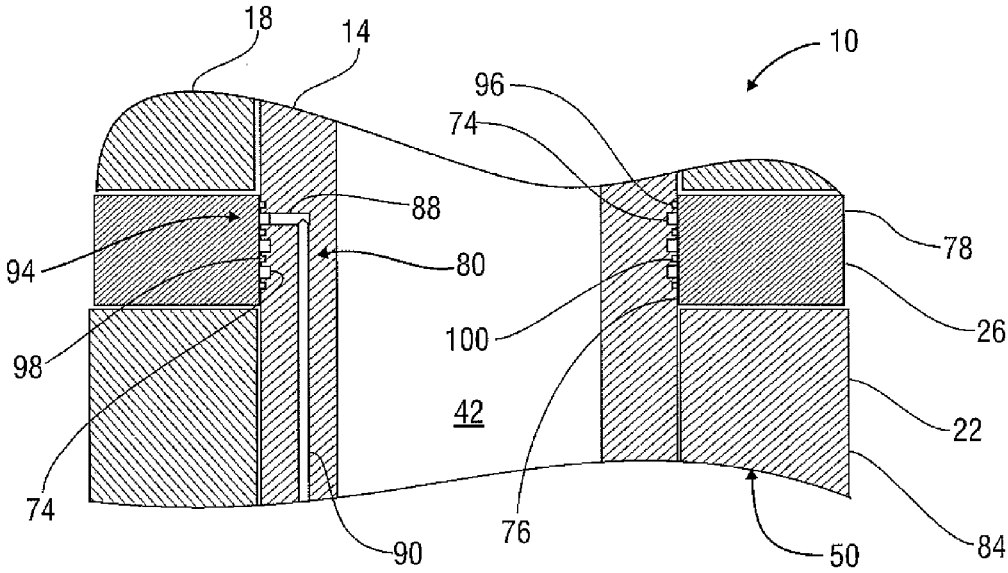
FIG. 12 is a cross-sectional view of the exemplary connecting system of FIG. 10 taken along lines 12-12.

In other embodiments, such as the example of FIGS. 10-12, the groove(s) 74 may instead be formed in the outer surface 84 of the barrel 14 to achieve the same uninterrupted flow path(s) 60. In yet other embodiments, grooves (not shown) may be formed in both the inner surface 76 of the communication ring 26 and the outer surface 84 of the barrel 14.

If desired, a communication line, hose or other component or device (not shown) may be engaged at each exit port 86 (FIG. 3) of the barrel 14 for transmission of the medium or media therethrough to the tool 34 (FIG. 2), other component (s) or device(s). The illustrated systems thus allow communication of the desired medium or media between at least one external source 61 (FIG. 4) and a tool 34 or other component or device associated with a top drive system 30.

Now referring back to FIG. 7, if desired, the flow paths 60 may be sealed around the flow interfaces 94 formed between the communication ring 26 and barrel 14. In this embodiment, a seal 96 is disposed between the communication ring 26 and barrel 14 above and below each interface. The seals 96 may have any suitable form, configuration and operation. For example, the seals 96 may be ring-shaped seals 98 disposed at least partially within respective cut-outs 100 formed in the inner surface 76 of the communication ring 26. In another example, the seals 96 of FIG. 12 are shown disposed within cut-outs 100 formed in the barrel 14. However, any suitable components or techniques may be used to seal around the interface(s) 94.

Preferred embodiments of the present disclosure thus offer advantages over the prior art and are well adapted to carry out one or more of the objects of this disclosure. However, the present disclosure does not require each of the components and acts described above and is in no way limited to the above-described embodiments, methods of operation, variables, values or value ranges. Any one or more of the above components, features and processes may be employed in any suitable configuration without inclusion of other such components, features and processes. Moreover, the present disclosure includes additional features, capabilities, functions, methods, uses and applications that have not been specifically addressed herein but are, or will become, apparent from the description herein, the appended drawings and claims.

The methods that are provided in or apparent from this disclosure or claimed herein, and any other methods which may fall within the scope of the appended claims, may be performed in any desired suitable order and are not necessarily limited to any sequence described herein or as may be listed in the appended claims. Further, the methods of the present disclosure do not necessarily require use of the particular embodiments shown and described herein, but are equally applicable with any other suitable structure, form and configuration of components.

While exemplary embodiments have been shown and described, many variations, modifications and/or changes of the system, apparatus and methods of the present disclosure, such as in the components, details of construction and operation, arrangement of parts and/or methods of use, are possible, contemplated by the patent applicant, within the scope of the appended claims, and may be made and used by one of ordinary skill in the art without departing from the spirit or teachings of the disclosure and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. Apparatus for allowing communication of one or more medium between at least one external source and a tool associated with a top drive system, the tool being useful in connection with a hydrocarbon exploration or production well disposed below the top drive system, the top drive system including a rotatable shaft extendable downwardly to the tool, the apparatus comprising:

a rotatable barrel positionable between the top drive system and the tool, said rotatable barrel having an upper end, a lower end and a central bore through which the rotatable shaft of the top drive system may extend and freely rotate, said rotatable barrel having a plurality of passages formed therein and isolated from one another, each said passage extending to a distinct exit port formed in said rotatable barrel, wherein at least one medium may be communicated between each said exit port and the tool;

a non-rotating upper housing extending at least partially around said rotatable barrel and having at least one coupler engageable with the top drive system;

a lower housing extending at least partially around said rotatable barrel between said non-rotating upper housing and said lower end of said rotatable barrel, said lower housing having at least one coupler engageable with the tool, said lower housing being rotatable; and a non-rotating communication ring extending at least partially around said barrel and having a plurality of separate passageways formed therein and extending therethrough, each said passageway being in communication with a distinct groove formed in and extending around the inner surface of said non-rotating communication ring, each said groove being in communication with one of said passages of said rotatable barrel regardless of the rotational movement of said rotatable barrel, each said corresponding passageway and groove being isolated from the other said passageway and groove combinations and being capable of communication with at least one external source, wherein at least two distinct, isolated flow paths are formed by said passageway and groove combinations of said non-rotating communication ring and said corresponding respective passages and exit ports of said rotatable barrel, allowing communication of at least one medium between at least one external source and the tool.

2. The apparatus of claim 1 wherein at least two said flow paths are configured to allow the communication of data or the transmission of signals therethrough.

3. The apparatus of claim 1 wherein at least two of said flow paths are configured to allow the flow of fluid therein and are fluidly isolated from one another.

4. The apparatus of claim 3 wherein each external source is a hydraulic or pneumatic flow line, further wherein said passageways of said non-rotating communication ring are configured to be engageable with at least one among a hydraulic and pneumatic flow line.

5. The apparatus of claim 3 further including at least five said fluidly isolated flow paths.

6. The apparatus of claim 3 wherein a distinct flow interface is formed between each said respective groove of said non-rotating communication ring and said corresponding passage of said rotatable barrel, further including a plurality of seals, at least one said seal being disposed between said non-rotating communication ring and said rotatable barrel above and below each said interface.

7. The apparatus of claim 6 wherein said seals are ring-shaped seals disposed at least partially within cut-outs formed in said non-rotating communication ring.

8. The apparatus of claim 6 wherein the tool is driven by the top drive system and said upper and lower housings each have a generally annular-shape, further wherein said lower housing and said rotatable barrel are coupled together and configured to rotate along with rotation of the tool.

9. The apparatus of claim 1 further including at least one retainer engaged between said lower housing and said rotatable barrel and configured to couple said lower housing to said rotatable barrel.

10. The apparatus of claim 9 wherein said at least one retainer includes a retainer ring threadably engaged with or bolted to said rotatable barrel proximate to said lower end thereof.

11. The apparatus of claim 1 wherein said rotatable barrel, non-rotating upper housing and lower housing are configured to assist in transferring the vertical load of the tool to the top drive system.

12. The apparatus of claim 11 further including at least one bearing assembly associated with said rotatable barrel and configured to allow rotation of said rotatable barrel and said lower housing and to assist in transferring the vertical load of the tool to the top drive system.

13. The apparatus of claim 12 wherein at least one said bearing assembly includes at least one annular-shaped roller thrust bearing assembly positioned proximate to said upper end of said rotatable barrel.

14. The apparatus of claim 12 wherein at least one said bearing assembly includes at least one annular-shaped roller thrust bearing assembly positioned between said upper and lower housings.

15. The apparatus of claim 11 wherein the top drive system includes at least one bail arm extending downwardly therefrom, wherein each said coupler of said non-rotating upper housing includes at least one link retainer releasably engageable with at least one bail arm of the top drive system, further wherein the tool is a casing running tool having at least one link extending therefrom, wherein each said coupler of said lower housing includes at least one link retainer releasably engageable with at least one link of the casing running tool.

16. The apparatus of claim 11 wherein the tool includes at least one among a cementing head, reaming drill bit and other device deployable into the well, wherein said lower housing is configured to bear the vertical load of the tool.

17. The apparatus of claim 1 further including at least eight said isolated flow paths.

18. The apparatus of claim 17 wherein each said groove is formed at a different respective location on the height of said non-rotating communication ring.

19. Apparatus for allowing communication of one or more medium between at least one external source and a tool associated with a top drive system, the tool being useful in connection with a hydrocarbon exploration or production well, the top drive system including a rotatable shaft extendable downwardly to the tool, the apparatus comprising:

a rotatable barrel positionable between the top drive system and the tool, said rotatable barrel having an upper end, a lower end and a central bore through which the rotatable shaft of the top drive system may extend and freely rotate, said rotatable barrel having a plurality of grooves formed in the outer surface thereof and extending around the circumference thereof, each said groove being isolated from the other said grooves, said rotatable barrel also having a plurality of passages formed therein and isolated from one another, each said passage extending from a different said groove to a distinct exit port formed in said rotatable barrel, wherein at least one medium may be communicated between each said exit port and the tool;

a non-rotating upper housing extending at least partially around said rotatable barrel and having at least one coupler engageable with the top drive system;

a lower housing extending at least partially around said rotatable barrel between said non-rotating upper housing and said lower end of said rotatable barrel, said lower housing having at least one coupler engageable with the tool, said lower housing being rotatable; and a non-rotating communication ring extending at least partially around said rotatable barrel and having a plurality of separate passageways formed therein and extending therethrough, each said passageway being in communication with one of said grooves of said rotatable barrel regardless of the rotational movement of said rotatable barrel, each said passageway being isolated from the other said passageways and capable of communication with at least one external source, wherein at least two distinct, isolated flow paths are formed by said passageways of said non-rotating communication ring and said corresponding respective grooves, passages and exit ports of said rotatable barrel, allowing communication of at least one medium between at least one external source and the tool.

20. The apparatus of claim 19 wherein a distinct flow interface is formed between each said respective passageway of said non-rotating communication ring and said corresponding groove of said rotatable barrel, further including a plurality of seals, at least one said seal being disposed between said non-rotating communication ring and said rotatable barrel above and below each said interface.

21. The apparatus of claim 20 wherein said rotatable barrel, non-rotating upper housing and lower housing are configured to assist in transferring the vertical load of the tool to the top drive system, further including at least one bearing assembly associated with said rotatable barrel and configured to allow rotation of said rotatable barrel and said lower housing and to assist in transferring the vertical load of the tool to the top drive system.

22. The apparatus of claim 20 wherein at least two of said flow paths are configured to allow the flow of fluid therein and are fluidly isolated from one another.

23. The apparatus of claim 22 further including at least five said fluidly isolated flow paths.

24. The apparatus of claim 19 further including at least eight said isolated flow paths.

25. The apparatus of claim 24 wherein each said groove is formed at a different respective location on the height of said rotatable barrel between said upper and lower ends thereof.

26. Apparatus for allowing fluid flow between at least one external source and a tool driven by a top drive system and useful in connection with a hydrocarbon exploration or production well, the top drive system including a rotatable shaft extendable to the tool, the apparatus comprising:

a rotatable barrel positionable between the top drive system and the tool, said rotatable barrel having an upper end, a lower end and a central bore through which the rotatable shaft of the top drive may extend and freely rotate, said rotatable barrel having a plurality of distinct passages formed therein and being fluidly isolated from one another, each said passage extending to a distinct exit port formed in said rotatable barrel, wherein fluid may be communicated between each said exit port and the tool;

a non-rotating upper housing extending at least partially around said rotatable barrel and having at least one coupler engageable with the top drive system;

a lower housing extending at least partially around said rotatable barrel between said non-rotating upper housing and said lower end of said rotatable barrel, said lower housing having at least one coupler engageable with the tool, said lower housing being rotatable; and a non-rotating communication ring extending at least partially around said barrel and having a plurality of separate passageways formed therein and extending therethrough, each said passageway being in constant fluid communication with a different one of said passages of said rotatable barrel regardless of the rotational movement of said rotatable barrel, each said passageway being fluidly isolated from the other said passageways and capable of fluid communication with at least one external fluid source, wherein at least two distinct, fluidly isolated flow paths are formed by said passageways of said non-rotating communication ring and said corresponding respective passages and exit ports of said rotatable barrel, allowing fluid communication between at least one external source and the tool.

27. The apparatus of claim 26 wherein said rotatable barrel, non-rotating upper housing and lower housing are configured to assist in transferring the vertical load of the tool to the top drive system.

28. The apparatus of claim 27 wherein said lower housing and said rotatable barrel are coupled together and configured to rotate along with rotation of the tool.

29. The apparatus of claim 28 further including at least one bearing assembly associated with said rotatable barrel and configured to allow rotation of said rotatable barrel and said lower housing and to assist in transferring the vertical load of the tool to the top drive system.

30. The apparatus of claim 28 wherein the top drive system includes at least one bail arm extending downwardly therefrom, wherein each said coupler of said non-rotating upper housing includes at least one link retainer releasably engageable with at least one bail arm of the top drive system, further wherein the tool is a casing running tool having at least one link extending therefrom, wherein each said coupler of said lower housing includes at least one link retainer releasably engageable with at least one link of the casing running tool.

31. The apparatus of claim 28 further including at least five said fluidly isolated flow paths.

32. The apparatus of claim 27 wherein the tool includes at least one among a cementing head, reaming drill bit and other device deployable into the well, wherein said lower housing is configured to bear the vertical load of the tool.

33. The apparatus of claim 26 further including at least eight said fluidly isolated flow paths.

* * * * *